US005407182A

United States Patent [19]

Hartley

[11] Patent Number: 5,407,182

[45] Date of Patent: Apr. 18, 1995

[54] SPACING JIG

[76] Inventor: Thomas Hartley, 9399 Suva St., Downey, Calif. 90240

[21] Appl. No.: 140,443

[22] Filed: Oct. 25, 1993

[51] Int. Cl.[6] ..... B25B 1/20

[52] U.S. Cl. ..... 269/43; 269/904

[58] Field of Search ..... 269/904, 43, 45, 287, 269/95, 97, 98; 249/207, 219 R; 211/41, 42, 184; 33/613, 562, 625

[56] References Cited

U.S. PATENT DOCUMENTS

| | | | |
|---|---|---|---|
| 2,567,586 | 9/1951 | Werder | 269/904 |
| 3,163,909 | 1/1965 | Williams | 269/904 |
| 3,300,057 | 1/1967 | Wheaton | 211/184 |
| 3,458,184 | 7/1969 | Schlosser | 269/904 |
| 3,552,734 | 1/1971 | Severino | 269/904 |
| 3,888,477 | 6/1975 | Tate | 269/904 |
| 4,061,322 | 12/1977 | Le Blanc | 269/904 |
| 4,671,483 | 6/1987 | Harbeke | 269/904 |
| 5,148,605 | 9/1992 | Julia | 269/43 |
| 5,215,198 | 6/1993 | Sutton | 211/41 |

*Primary Examiner*—Robert C. Watson
*Attorney, Agent, or Firm*—Robert M. Sperry

[57] ABSTRACT

An improved forming jig comprising a flat strip of rigid material having a plurality of projections extending from one surface of said strip, one pair of said projections being located at each end of said strip and being spaced approximately 1 9/16 inches from each other, an additional one of said projections spaced approximately 1 9/16 inches from the inner projection of one of said pairs and approximately 5¾ inches from the inner projection of the other of said pairs, and having an opening formed in said strip located approximately four inches from the end of said strip adjacent said other of said pairs. If desired a carpenters level may be mounted on the surface of said strip opposite from said projections.

7 Claims, 2 Drawing Sheets

SPACING JIG

BACKGROUND

1. Field of Invention

This invention relates to building construction and is particularly directed to improved means for measuring and installingretaining the spacing of forming boards in preparation for pouring concrete stem walls and the like.

2. Prior Art

In the past, it has always been difficult and tedious to erect stem wall type raised foundation forming systems. For example, when setting forms for a six or eight inch foundation wall, it is necessary to lay string lines to indicate the proper locations of the inner and outer forming boards. Form stakes are then driven into the ground along the string lines and the forming boards are nailed onto the form stakes. However, the spacing and levelness of the forming boards must be checked repeatedly and spacing ties must be nailed to the inner and outer forming boards at frequent intervals to assure that the proper spacing is maintained. Also, bracing stakes must be attached to the forming boards at frequent intervals to further assure the proper spacing. In addition, frequent measurements must be made along the spacing ties and holes must be drilled at the appropriate locations to install J-bolts which are to be embedded in the concrete. Obviously, the repeated checking and nailing of the spacing ties and bracing stakes and the measuring and drilling of the holes for the J-bolts is extremely labor intensive and time consuming. Moreover, the spacing ties and bracing stakes are usually fabricated on site and are discarded after the concrete foundation has set, which results in considerable waste of boards and nails and, hence, increases the cost of labor and material for such operations.

Numerous devices have been proposed heretofore for overcoming these difficulties. However, most of the prior art devices have been expensive to purchase, have been complex and difficult to use and have required considerable maintenance. A search in the United States Patent Office has revealed the following:

| U.S. PAT. NO. | INVENTOR | ISSUED |
|---|---|---|
| 2,837,807 | G.P. McGraw | Jun. 10, 1958 |
| 3,128,524 | J.D. Kay | Apr. 14, 1964 |
| 3,163,909 | H.M. Williams | Jan. 5, 1965 |
| 3,203,070 | T.M. Kolakowski et al | Aug. 31, 1965 |

Each of these references is subject to the disadvantages discussed above. Thus, none of the prior art forming jigs have been entirely satisfactory.

BRIEF SUMMARY AND OBJECTS OF INVENTION

These disadvantages of the prior art are overcome with the present invention and an improved forming jig is provided which is simple and inexpensive to purchase and use and which requires absolutely no maintenance, yet which greatly reduces the labor time and cost of installation and which can be removed and reused repeatedly to minimize the cost of materials.

These advantages of the present invention are preferably attained by providing an improved forming jig comprising a flat strip of rigid material having a plurality of projections extending from one surface of said strip, one pair of said projections being located at each end of said strip and being spaced approximately 1 9/16 inches from each other, an additional one of said projections spaced approximately 1 9/16 inches from the inner projection of one of said pairs and approximately 5¾ inches from the inner projection of the other of said pairs, and having an opening formed in said strip located approximately four inches from the end of said strip adjacent said other of said pairs. If desired a carpenters level may be mounted on the surface of said strip opposite from said projections.

Accordingly, it is an object of the present invention to provide an improved forming jig.

Another object of the present invention is to provide an improved forming jig which is simple and inexpensive to purchase and use.

An additional object of the present invention is to provide an improved forming jig which requires absolutely no maintenance.

A further object of the present invention is to provide an improved forming jig which greatly reduces the labor time and cost of installation.

Another object of the present invention is to provide an improved forming jig which can be removed and reused repeatedly to minimize the cost of materials.

An additional object of the present invention is to provide an improved forming jig having means for locating and holding rods to be embedded in a wall.

A specific object of the present invention is to provide an improved forming jig comprising a flat strip of rigid material having a plurality of projections extending from one surface of said strip, one pair of said projections being located at each end of said strip and being spaced approximately 1 9/16 inches from each other, an additional one of said projections spaced approximately 1 9/16 inches from the inner projection of one of said pairs and approximately 5¾ inches from the inner projection of the other of said pairs, and having an opening formed in said strip located approximately four inches from the end of said strip adjacent said other of said pairs. If desired a carpenters level may be mounted on the surface of said strip opposite from said projections.

These and other objects and features of the present invention will be apparent from the following detailed description, taken with reference to the figures of the accompanying drawing.

DETAILED DESCRIPTION OF THE INVENTION

Figure 1:
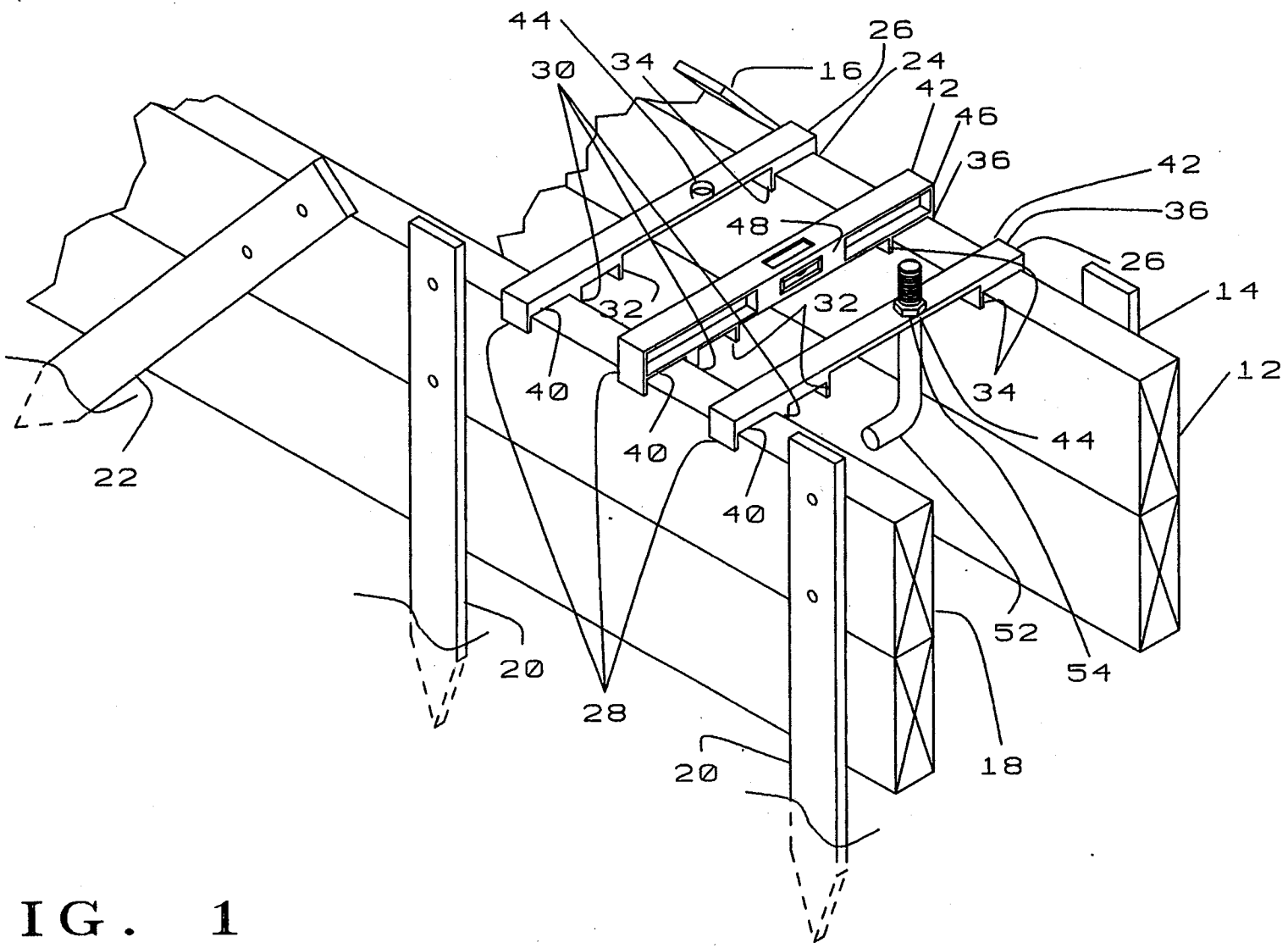
FIG. 1 is a diagrammatic representation showing a plurality of forming jigs, embodying the present invention, as used to space the forms for a stem wall.
Figure 2:
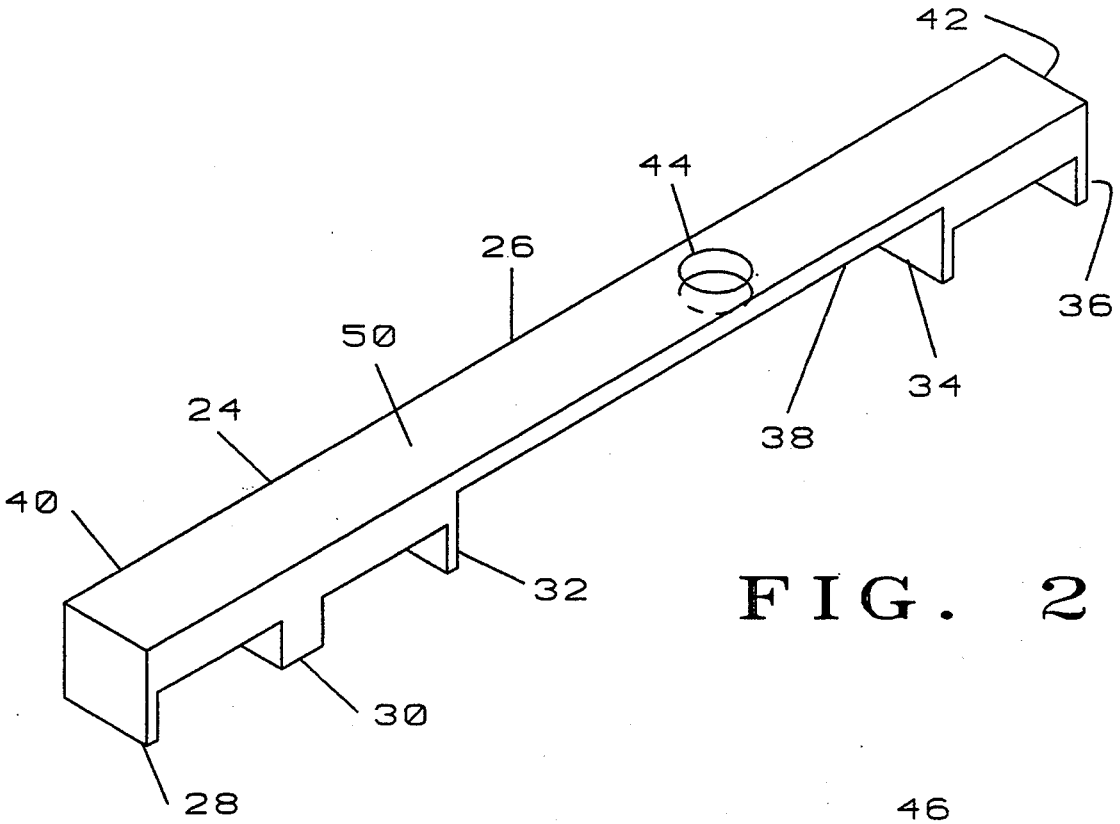
FIG. 2 is an isometric view of the forming jigs of FIG. 1.

In that form of the present invention chosen for purposes of illustration, FIG. 1 shows an exterior form board 12, supported by stakes 14 and a brace 16, and interior form boards 18 and 19 are supported by stakes 20 and a brace 22. To ensure proper alignment of the interior form boards 18 and 19, a plurality of forming jigs 24, embodying the present invention, are positioned on the upper edge of the form boards 12 and 18 at suitably spaced intervals along the form boards 12 and 18, preferablt at required bolt locations. As best seen in FIG. 2, each of the forming jigs 24 comprises a flat strip 26 of rigid material having a plurality of projections 28, 30, 32, 34 and 36 extending downward from the bottom surface 38 of said strip 28. Preferably, the projections 28, 30, 32, 34 and 36 will extend downward approximately 1 inch below the bottom surface 38 of the strip 26. As shown, a first pair of projections 28 and 30 are located adjacent one end 40 of said strip 26 and are spaced approximately 1 9/16 inches from each other. Similarly, a second pair of projections 34 and 36 are located adjacent the opposite end 42 of the strip 26 and are spaced approximately 1 9/16 inches from each other. An additional one of the projections 32 is spaced approximately 1 9/16 inches inward from the inner projection 30 of the first pair and approximately 5¾ inches from the inner projection 34 of the second pair. Finally, an opening 44 is formed in said strip located approximately four inches from end 42 of the strip 26.

Figure 3:
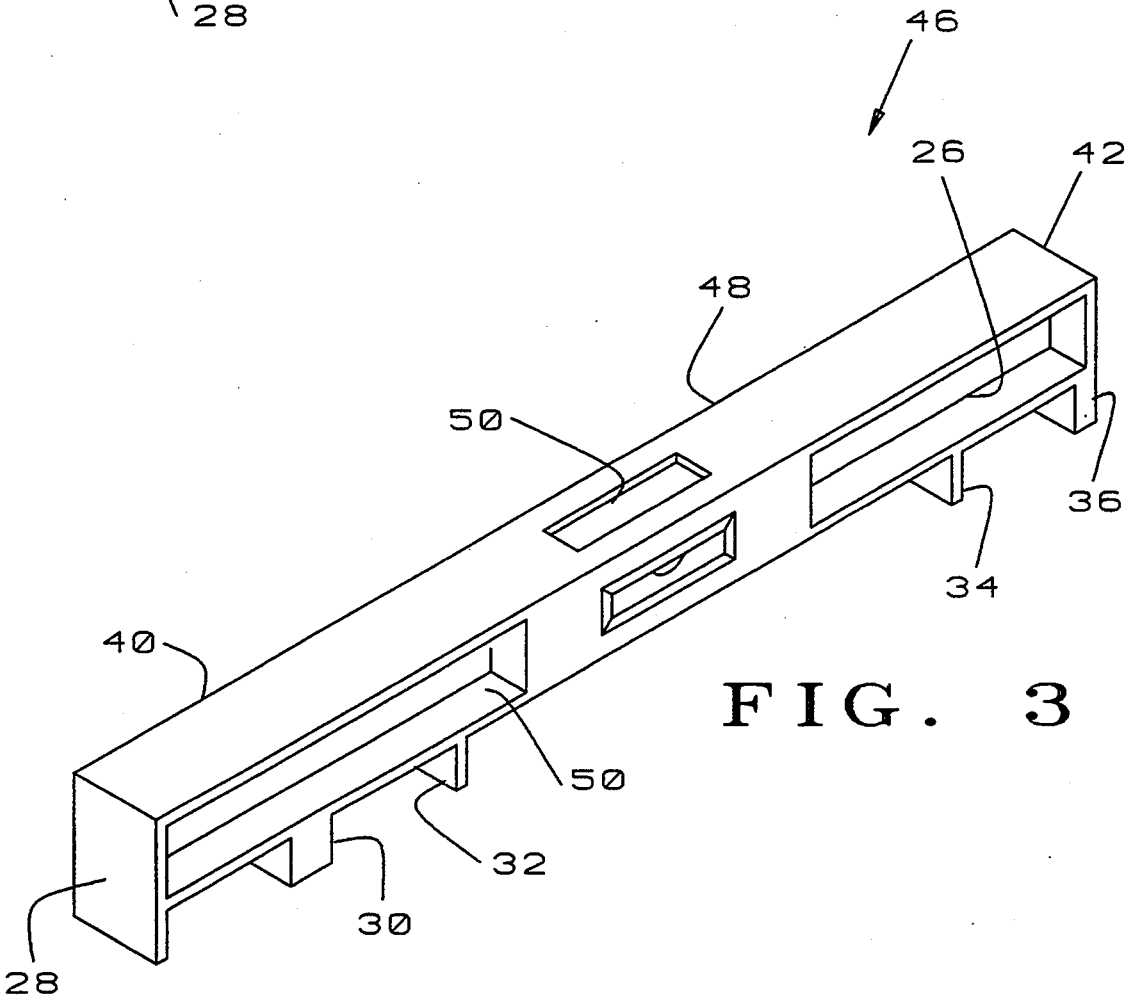
FIG. 3 is a view, similar to that of FIG. 2, showing a modified form of the forming jig of FIG. 2 having a level mounted on one surface of the jig.

FIG. 3 shows an alternative form, indicated generally at 46, of the forming jig 24 of FIG. 2. In this form of the present invention, a carpenters level 48 is mounted on the upper surface 50 of said strip 26, as seen in FIGS. 2 and 3. If desired, suitable attaching means, not shown, such as a strip of magnetic material, may be applied to the upper surface 50 of the forming jig 24 to releasably attach the carpenters level 48 to the forming jig 24.

In use, the exterior form board 12 is installed in the usual manner. Thereafter, the interior stakes 20 are driven into the ground and form boards 19 and 20 are attached. Several of the forming jigs 24 are positioned at spaced intervals, such as bolt locations, along the upper edges of both the outer form board 12 and the upper one of the interior form boards 18, thereby automatically providing proper spacing of the stakes 20 and, hence, of the interior form boards 18 and 19, with respect to the exterior form board 12 in a locked position. If the desired spacing between the exterior form board 12 and the interior form boards 18 and 19 is eight inches, form board 18 will be inserted between projections 30 and 32 of the jigs 24, as seen in FIG. 1. Alternatively, if the desired spacing between the exterior form board 12 and the interior form boards 18 and 19 is six inches, form board 18 will be inserted between projections 30 and 32 of the jigs 24. Because the positions of the projections 28, 30, 32, 34 and 36 are fixed, this allows installation of the interior forming boards 18 and 19 without requiring the use of string lines and repeated measurement of the separation between the exterior form board 12 and the interior form board 18, which saves a significant amount of time and labor. Thereafter, by employing the forming jig 46 of FIG. 3, or by placing a carpenters level, not shown, on the upper surface 50 of one of the forming jigs 24, the installer can watch the level 48 as the interior form board 18 is nailed to the stakes 20 and can quickly and easily establish the proper height. This saves additional time and labor. Furthermore, to install J-bolts, the worker simply inserts the J-bolt 52 through the pre-drilled openings 44 and secures them with a nut, as seen at 54 in FIG. 1. Again, no additional measurement is required for this operation, which saves additional time and labor. Finally, when the concrete of the stem wall has been poured and set, the forming jigs 24 can quickly and easily be removed for subsequent reuse, which results in significant saving in material costs.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A forming jig comprising:

a flat strip of rigid material having a plurality of projections extending from one surface of said strip, an opening formed in said strip located a predetermined distance from an end of said strip, two pairs of said projections, each being located adjacent a respective end of said strip with the projections of each pair being spaced a predetermined distance from each other, an additional one of said projections being spaced a first predetermined distance from the inner projection of one of said pairs and a second predetermined distance from the inner projection of the other of said pairs.

2. The forming jig of claim 1 wherein:

said opening is formed a predetermined distance from the end of said strip adjacent said other of said pairs.

3. The forming jig of claim 1 further comprising:

a carpenters level mounted on the surface of said strip opposite from said projections.

4. The forming jig of claim 1 wherein:

the projections of each of said pairs are spaced approximately 1 9/16 inches from each other.

5. The forming jig of claim 1 wherein:

said additional projection is spaced approximately 1 9/16 inches from the inner projection of one of said pairs and approximately 5¾ inches from the inner projection of the other of said pairs.

6. The forming jig of claim 2 wherein:

said opening is formed approximately 5¾ inches from said end of said strip.

7. The forming jig of claim 1 further comprising:

means mounted on the surface of said strip opposite from said projections for releasably attaching a carpenters level to said surface.

* * * * *